US007581964B2

(12) United States Patent
Fujimaki et al.

(10) Patent No.: US 7,581,964 B2
(45) Date of Patent: Sep. 1, 2009

(54) UNIT WITH BUILT-IN CONTROL CIRCUIT

(75) Inventors: Hirohiko Fujimaki, Shizuoka (JP); Ryuji Matsuura, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 12/003,714

(22) Filed: Dec. 31, 2007

(65) Prior Publication Data

US 2008/0176423 A1 Jul. 24, 2008

(30) Foreign Application Priority Data

Jan. 18, 2007 (JP) ..... 2007-009503

(51) Int. Cl.
*H01R 12/00* (2006.01)

(52) U.S. Cl. ..... 439/76.1

(58) Field of Classification Search ..... 439/76.1, 439/76.2, 715, 712, 404, 417, 441; 361/647, 361/601; 174/59, 50

See application file for complete search history.

(56) References Cited

U.S. PATENT DOCUMENTS 6,386,919 B2 * 5/2002 Medina et al. ..... 439/610
2005/0006733 A1 * 1/2005 Shirasaka et al. ..... 257/666

FOREIGN PATENT DOCUMENTS

JP 2004-288425 10/2004

* cited by examiner

*Primary Examiner*—Alexander Gilman
(74) *Attorney, Agent, or Firm*—Edwards Angell Palmer & Dodge LLP

(57) ABSTRACT

A unit with a built-in control circuit includes an outer housing and a control circuit package. The outer housing includes an electric wire holding part and receives the control circuit package. The control circuit package includes a lead frame, an IC chip, and a plastic molding body. The lead frame is made of conductive metal, and includes crimping terminals 20 and male tabs. The electric wire is press-fitted into the crimping terminal. The male tabs are connected to a mating connector. The IC chip is mounted on the lead frame. The plastic molding body covers and receives the IC chip and a center part of the lead frame.

4 Claims, 4 Drawing Sheets

UNIT WITH BUILT-IN CONTROL CIRCUIT

CROSS REFERENCE TO RELATED APPLICATIONS

This application is on the basis of Japanese Patent Application No. 2007-009503, the contents of which are hereby incorporated by reference.

BACKGROUND OF THE INVENTION

1. Field of the Invention

The present invention relates to a unit with a built-in control circuit receiving various circuit elements to be used in connecting an electric wire or the like.

2. Description of the Related Art

Various electric components such as an air-conditioner, a windshield wiper, a power window and the like are mounted on a vehicle. A wiring harness is arranged in a vehicle for supplying electricity or a control signal to the electric components. The wiring harness includes a plurality of electric wires and a connector for receiving terminal fittings to be connected to ends of the electric wires. The electric wire is a so-called covered wire having a conductive core wire and an insulating sheath covering the core wire.

For example, an electronic unit having connectors disclosed in Patent Document 1 is used as a unit with a built-in control circuit in which an electronic unit is embedded for connecting the connector of the wiring harness to drive and control the electric components via the wiring harness. The electronic unit having connectors disclosed in Patent Document 1 includes: a transmission control unit 20 composed of a print circuit board on which various circuit elements are mounted; connectors at both sides of the electric unit; a unit housing receiving the transmission control unit 20; and a cover 13*b* for covering an opening formed on the unit housing. In each connector of the electronic unit having connectors, terminals made of conductive metal are projected from the transmission control unit 20 and connected to terminals of a mating connector.

When the other ends of the terminals connected to the electronic unit having connectors are connected to the other connector or various electric components, the connector disclosed in the Patent Document 1 connects the electric wires connected to the other connector and the electric component in a predetermined pattern via the electronic unit having connectors.

[Patent Document 1] Japanese Published Patent Application No. 2004-288425

In the electronic unit having connectors disclosed in the Patent Document 1, a connector for connecting the connector of the wiring harness extended from the electric component is formed on the unit housing receiving the transmission control unit 20. Therefore, a volume of the unit housing is increased, and terminals for connecting to the connector of the wiring harness and the transmission control unit 20 are needed. Accordingly, a cost of the electronic unit is increased, and assembling time for receiving the terminals in each connector is increased.

Accordingly, an object of the present invention is to provide a unit with a built-in control circuit to be able to be small-sized, to reduce a cost thereof, and to make an assembling thereof easy.

SUMMARY OF THE INVENTION

In order to attain the object, according to the present invention, there is provided a unit with a built-in control circuit including:

a control circuit part on which circuit elements are mounted, having an electric wire connecting part;

a unit housing having an opening for receiving the control circuit part; and a cover for holding a plurality of electric wires, covering the unit housing after attached to the opening, and connecting the electric wires to the electric wire connecting part.

Preferably, the control circuit part is composed of a control circuit package including: a lead frame integrally having the electric wire connecting part; the circuit elements mounted on the lead frame; and a plastic molding body in which the electric connecting part is exposed, and the circuit elements and the lead frame are molded.

Preferably, the electric wire connecting part includes a pressure welding blade for pressure welding the electric wire.

Preferably, the lead frame further includes a connector connecting part exposed from the plastic molding body, and the unit housing includes a hood for receiving the connector connecting part and for being fitted with a mating connector receiving external terminals to be connected to the connector connecting part.

These and other objects, features, and advantages of the present invention will become more apparent upon reading of the following detailed description along with the accompanied drawings.

DETAILED DESCRIPTION OF THE PREFERRED EMBODIMENTS

An embodiment of a unit with a built-in control circuit 1 according to the present invention will be explained with reference to FIGS. 1 to 6.

Figure 1:
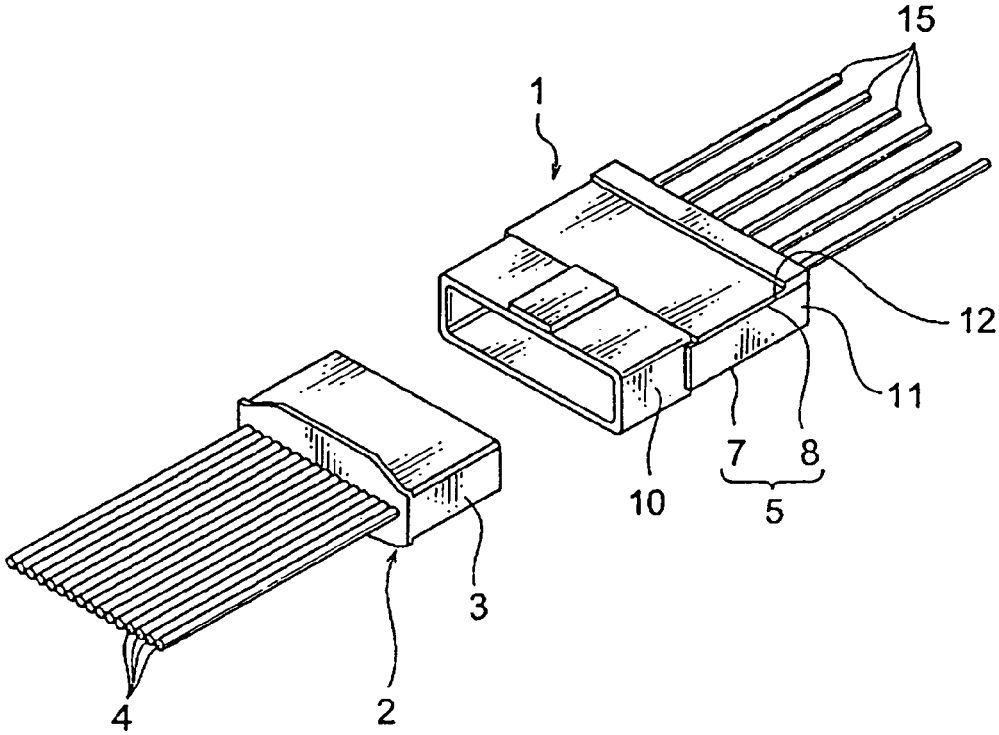
FIG. 1 is a perspective view showing a connector of a unit with a built-in control circuit and a mating connector according to an embodiment of the present invention.
Figure 2:
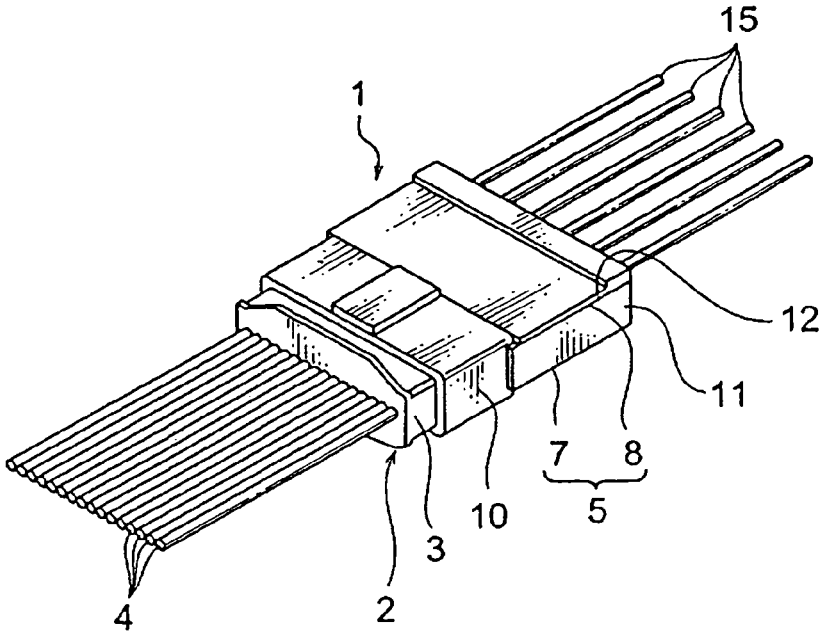
FIG. 2 is a perspective view showing the connectors shown in 1 connected to each other.

As shown in FIGS. 1 to 2, the built-in control circuit 1 is connected to a mating connector 2. The mating connector 2 includes a connector housing 3 and not-shown terminal fittings as external terminals. The connector housing 3 is made of insulating synthetic resin, and formed in a flat box shape. The connector housing 3 receives the terminal fittings. An electric wire 4 having a core wire and a sheath covering the core wire is attached to each terminal fitting. The terminal fitting is electrically connected to the electric wire attached thereto.

Figure 3:
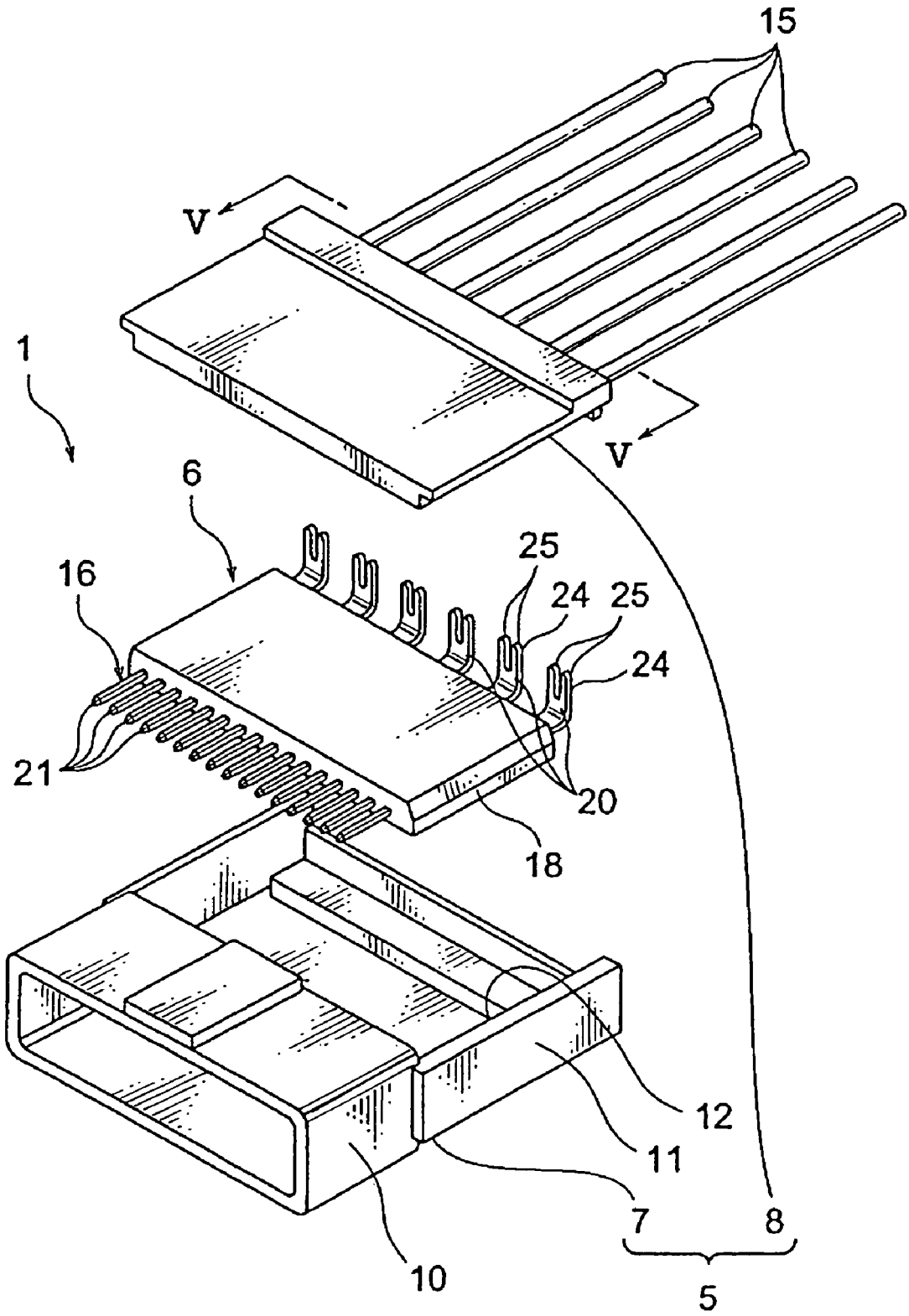
FIG. 3 is an exploded perspective view showing the unit with a built-in control circuit shown in FIG. 1.
Figure 4:
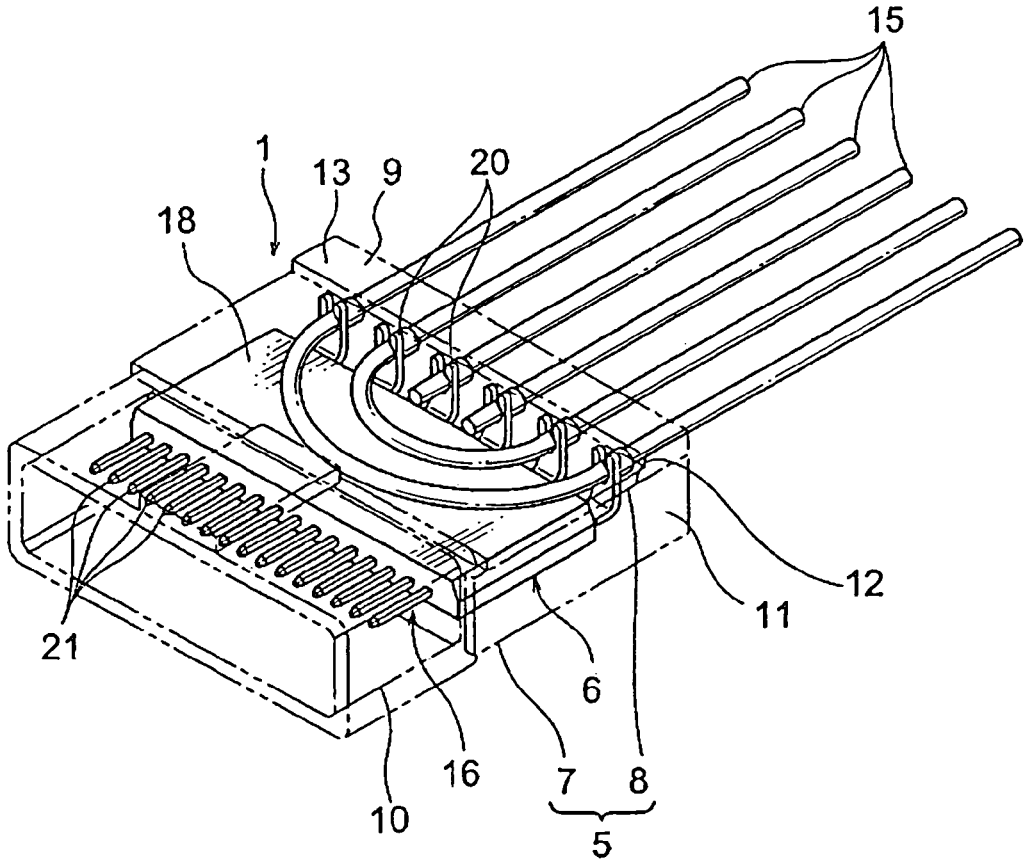
FIG. 4 is a perspective view showing the unit with a built-in control circuit shown in FIG. 3.

As shown in FIGS. 3 and 4, the built-in control circuit 1 includes an outer housing 5 and a control circuit package 6 as a control circuit part. The outer housing 5 is formed in a flat box shape, and includes a unit housing 7, a cover 8, and electric wire holding part 9 (shown in FIG. 5).

The unit housing 7 is made of insulating synthetic resin, and includes a tubular hood 10, and a control circuit package receiving chamber 11 extended from the hood 10. The connector housing 3 of the mating connector 2 is inserted into an interior of the hood 10 to be connected to the hood 10. The control circuit package receiving chamber 11 is formed in a U-shaped section, and an opening 12 is formed on an upper part of the control circuit package receiving chamber 11.

The cover 8 is made of insulating synthetic resin, and formed in a plate shape. The cover 8 is attached to the unit housing 7. When attached to the unit housing 7, the cover 8 covers the opening 12.

Figure 5:
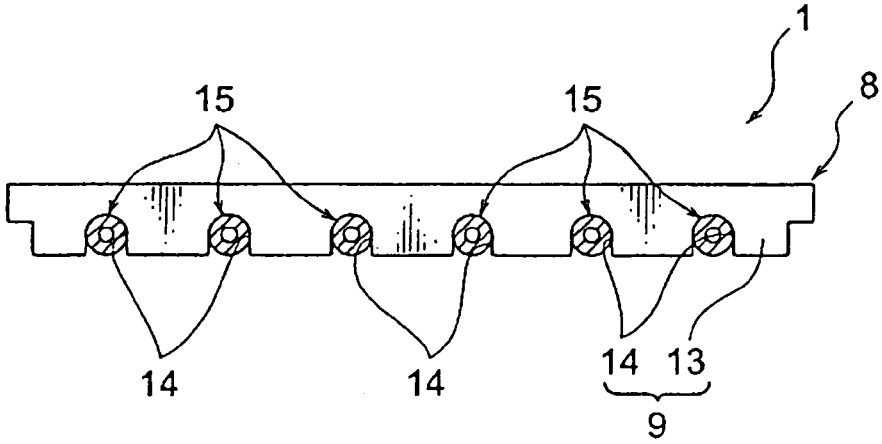
FIG. 5 is a sectional view taken on line V-V in FIG. 3.

As shown in FIG. 5, the electric wire holding part 9 includes a plurality of electric wire receiving grooves 14 formed on the cover 8. The electric wire receiving grooves 14 are arranged with a gap relative to each other. An electric wire 15 is inserted into an inside of the electric wire receiving groove 14 and the electric wire receiving groove 14 holds the electric wire 15. For holding the electric wire 15, a radius of the electric wire receiving groove 14 is a little smaller than that of the electric wire 15. Alternatively, a locking projection is formed on the electric wire receiving groove 14 for holding the electric wire 15.

The outer housing 5 positions the control circuit package 6 between the unit housing 7 and the cover 8 to receive the control circuit package 6.

Incidentally, in FIG. 4, two electric wires 15 are held in the electric wire receiving grooves 14 at an end of the electric wire holding part 9, U-turned in the outer housing 5, and held at the other end of the electric wire holding part 9. Another two electric wires 15 are held in each electric wire receiving groove 14. However, such an arrangement is properly changed according to a circuit configuration.

Figure 6:
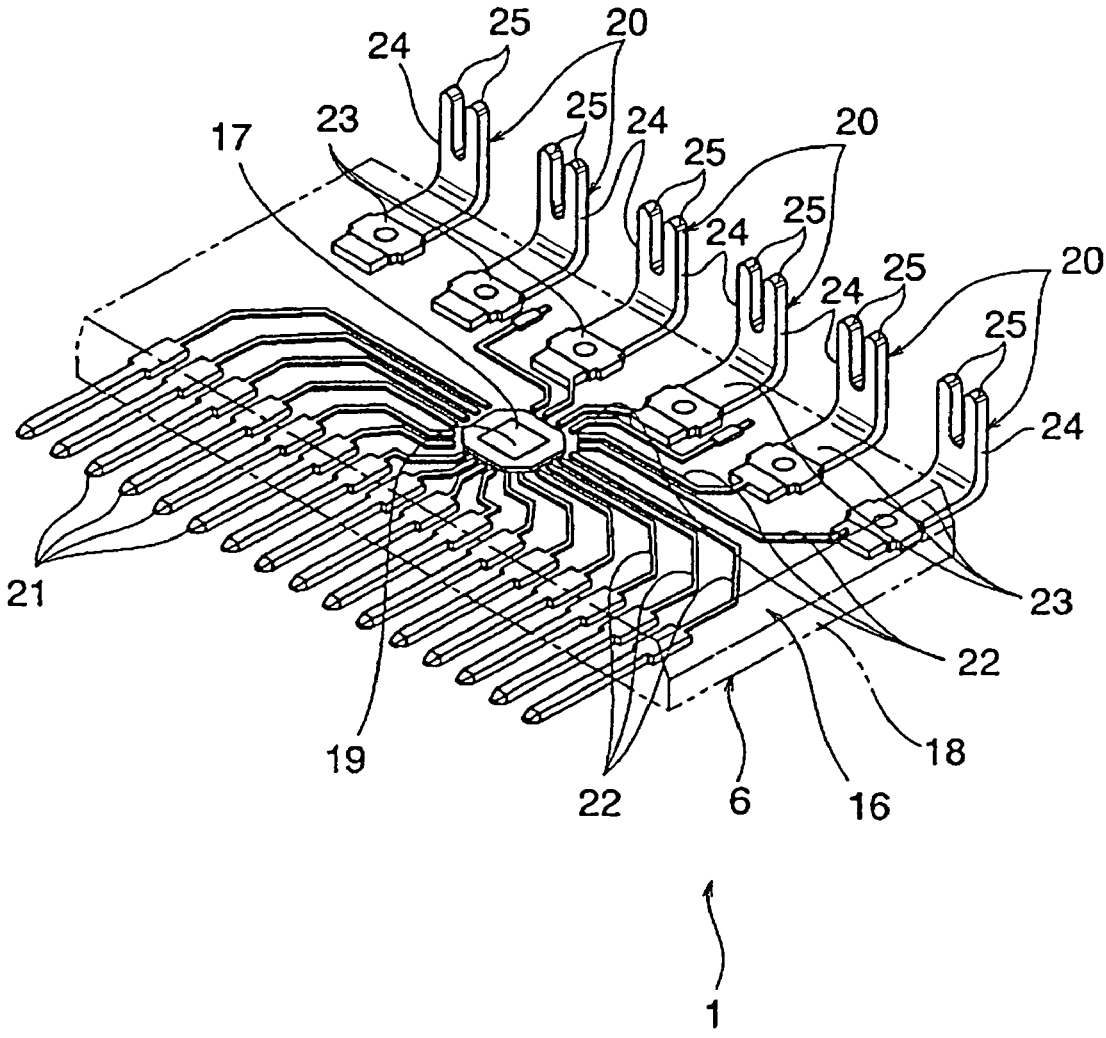
FIG. 6 is a perspective view showing a control circuit package of the unit with a built-in control circuit shown in FIG. 3.

As shown in FIG. 6, the control circuit package 6 includes a lead frame 16, an IC chip 17 as a circuit element, and a plastic molding body 18. The lead frame 16 is made of conductive metal, and integrally includes a chip holding part 19, a plurality of crimping terminals 20 as the electric wire connecting parts, a plurality of male tabs 21 as the connector connecting parts, and a plurality of wiring parts 22.

The chip holding part 19 is formed in a flat shape. The IC chip 17 is jointed on the chip holding part 19 with an epoxy resin, sliver paste, or solder. The crimping terminals 20 are arranged with a gap relative to each other. The crimping terminals 20 are disposed as many as the electric wire receiving grooves 14.

Each crimping terminal 20 integrally includes a horizontal part 23 and a vertical part 24. The horizontal part 23 is formed in a band plate shape. Front and back surfaces of the horizontal part 23 are arranged in same planes as front and back surfaces of the chip holding part 19. The horizontal parts 23 of the crimping terminals 20 are arranged parallel to each other. The horizontal parts 23 of the crimping terminals 20 are arranged with a gap relative to the chip holding part 19.

The vertical part 24 is vertically extended from an end of the horizontal part 23 away from the chip holding part 19. In FIG. 6, both surfaces of the vertical part 24 are perpendicular to both surface of the horizontal part 23. Both surfaces of the vertical part 24, namely, both surfaces of a later-described pressure welding blade 25 is parallel to an attaching direction of the cover 8 to the unit housing 7.

Further, the vertical parts 24 are extended from the horizontal parts 23 in the same direction as each other. Each vertical part 24 includes a pair of pressure welding blades 25 disposed with a gap in a width direction of the crimping terminal 20, namely, in a direction of arranging the crimping terminals 20. A pair of pressure welding blades 25 catches the electric wire 15 therebetween, and cuts the sheath of the electric wire 15 to contact the core wire of the electric wire 15.

Each male tab 21 is formed in a bar shape and extended straight. The male tabs 21 are arranged with a gap relative to each other. The chip holding part 19 is interposed between the crimping terminals 20 and the male tabs 21.

After the control circuit package 6 is received in the outer housing 5, the male tabs 21 are connected to the terminals in the mating connector 2 fitted into the hood 10.

The wiring parts 22 are formed in a curved shape for extending toward the chip holding part 19 from the crimping terminals 20 and the male tabs 21. Some parts of the wiring parts 22 connect the chip holding part 19 to the crimping terminals 20, and the other parts of the wiring parts 22 connect the chip holding part 19 to the male tabs 21.

The IC chip 17 is disposed on the chip holding part 19, and attached to the lead frame 16. The IC chip 17 is connected to the wiring parts 22 with well-known bonding wires. The IC chip 17 electrically connects the crimping terminals 20 and the male tabs 21 according to a predetermined pattern via the wiring parts 22. Thus, the IC chip 17 is mounted on the lead frame 16.

The plastic molding body 18 is made of synthetic resin, and formed in a flat box shape. The plastic molding body 18 packages the chip holding part 19, the horizontal part 23 of the crimping terminals 20, base ends of the male tabs 21 near the chip holding part 19, and the wiring parts 22 by receiving them in a molding die and molding. Namely, the plastic molding body 18 covers and receives the IC chip 17 and the center of the lead frame 16. The plastic molding body 18 packages the IC chip 17 and the lead frame 16, and the crimping terminals 20 and the male tabs 21 are exposed from the plastic molding body 18.

The connector (unit with a built-in control circuit) 1 described above is assembled as described below. Firstly, the electric wire 15 is held in the electric wire holding part 9 formed on the cover 8, and the control circuit package 6 is inserted into the unit housing 7 via the opening 12. At this time, the male tabs 21 are positioned in the hood 10, and the vertical parts 24, namely, the pressure welding blades 25 are extended vertically from a bottom wall of the control circuit package receiving chamber 11. Then, the cover 8 is gradually moved toward the opening 12. Then, the electric wires 15 held in the electric wire receiving grooves 14 of the electric wire holding part 9 are gradually inserted into between the corresponding pressure welding blades 25 of the vertical parts 24. Then, the cover 8 fully closes the opening 12 to be attached to the unit housing 7, and the electric wires 15 are press-fitted into between the pressure welding blades 25. The pressure welding blades 25 cut the sheath of the electric wire 15 and contact the core wire of the electric wire 15.

Thus, the connector (unit with a built-in control circuit) 1 is assembled. This connector 1 is connected to the mating connector 2. In the connector 1, the IC chip 17 connects mating electric wires 4 in the mating connector 2 to the electric wires 15 press-fitted into the crimping terminals 20 according to the predetermined pattern.

According to this embodiment, because the crimping terminals 20 include pressure welding blades 25, the electric wires 15 can be attached to the crimping terminals 20 only by press-fitting the electric wire 15 into between the pressure welding blades 25. Therefore, time to connect the electric wires 15 to the crimping terminals 20 can be reduced. Therefore, the connector (unit with a built-in control circuit) 1 is easily connected to the electric wires 15.

Further, because the vertical parts 24, namely, the pressure welding blades 25 of the crimping terminals 20 are extended in a direction of moving the cover 8 toward the unit housing 7, the electric wires 15 can be attached to the crimping terminals 20 by moving the cover 8 toward the unit housing 7.

Because the electric wire holding part 9 is formed on the outer housing 5, when the plastic molding body 18 receives the outer housing 5 after the electric wire holding part 9 holds the electric wires 15, the electric wires 15 held in the electric wire holding part 9 can be press-fitted into between the pressure welding blade 25. Therefore, time to connect the electric wires 15 to the crimping terminals 20 can be surely reduced, and the electric wires 15 are more easily connected to the crimping terminals 20.

Because the lead frame 16 includes the male tabs 21 as the connector connecting part, a relay unit used in a conventional connector having an electronic unit is not needed. The mating connector 2 can be directly connected to the connector (unit with a built-in control circuit) 1.

According to this embodiment, the lead frame 16 includes both the crimping terminals 20 as the electric wire connecting parts, and the male tabs 21 as the connector connecting parts. However, according to the present invention, the lead frame 16 only includes the electric wire connecting parts. Namely, the mating connector 2 may include the cover 8 with electric wires, and the crimping terminals 20 may be disposed at both sides of the control circuit part (the control circuit package 6).

Further, according to this embodiment, the lead frame 16 includes the crimping terminals 20 as the electric wire connecting parts. However, according to the present invention, a flat cable may be used as the electric wires, and a piercing terminal may be used for piercing core wires of the flat cable. In short, according to the present invention, various members can be used as long as they can be connected to the mating connector 2 as the connector connecting part.

Further, according to this embodiment, the plastic molding body 18 of the control circuit package 6 is formed in a flat shape. However, according to the present invention, the plastic molding body 18 may be formed in a hollow box body, covering the lead frame 16 and the IC chip 17.

Further, according to this embodiment, the control circuit package 6 is composed of electronic elements such as the lead frame 16, the IC chip 17 mounted on the lead frame 16. However, according to the present invention, similar to a conventional electronic unit, the lead frame 16 may be composed of a print circuit board and electronic elements mounted on the print circuit board. In this case, when at least some parts of the terminals mounted on the print circuit board are the crimping terminals, an object of the present invention is attained.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. A unit with a built-in control circuit comprising:

a control circuit part on which circuit elements are mounted, having an electric wire connecting part;

a unit housing having an opening for receiving the control circuit part; and a cover retaining a plurality of electric wires received therein, covering the unit housing after attached to the opening, and connecting the electric wires to the electric wire connecting part, whereby when the cover is attached to the unit housing, the electric wires retained by the cover are respectively pressed into between blades of press contact terminals to connect terminals to the electric wires.

2. The unit as claimed in claim 1, wherein the control circuit part is composed of a control circuit package including: a lead frame integrally having the electric wire connecting part; the circuit elements mounted on the lead frame; and a plastic molding body in which the electric connecting part is exposed, and the circuit elements and the lead frame are molded.

3. The unit as claimed in claim 1, wherein the lead frame further includes a connector connecting part exposed from the plastic molding body, and the unit housing includes a hood for receiving the connector connecting part and for being fitted with a mating connector receiving external terminals to be connected to the connector connecting part.

4. he unit as claimed in claim 1, wherein a control circuit part further includes a connector connecting part having a plurality of male tabs and the electric wire connecting part having a plurality of crimping terminals, whereby the connector connecting part is connected to the electric wire connecting part.

* * * * *